United States Patent [19]

Fisher, Jr.

[11] 4,378,839

[45] Apr. 5, 1983

[54] WELL TOOL

[75] Inventor: Ernest P. Fisher, Jr., Carrollton, Tex.

[73] Assignee: Otis Engineering Corporation, Dallas, Tex.

[21] Appl. No.: 249,189

[22] Filed: Mar. 30, 1981

[51] Int. Cl.[3] ..... E21B 23/00

[52] U.S. Cl. ..... 166/217; 166/317; 166/322; 166/382; 285/315

[58] Field of Search ..... 166/217, 216, 215, 317, 166/125, 322, 382, 206, 207-209; 285/18, 3; 285/141, 315, 321

[56] References Cited

U.S. PATENT DOCUMENTS

| | | | |
|---|---|---|---|
| 840,791 | 5/1970 | Moore, Jr. | 166/322 |
| 3,507,329 | 4/1970 | Stone, Jr. | 166/217 |
| 3,638,723 | 2/1972 | Carroll | 166/215 |
| 3,863,715 | 2/1975 | Yonker | 166/217 |

*Primary Examiner*—Ernest R. Purser
*Assistant Examiner*—Thuy M. Bui
*Attorney, Agent, or Firm*—Vinson & Elkins

[57] ABSTRACT

A subsurface safety valve is combined with a locating means for locating the safety valve as it is pumped down into the well. A locking mandrel is provided that locks the safety valve in position after it has been located by a downward force being exerted on the locking means. When it is desired to remove the subsurface safety valve a pulling tool is run in and a downward force exerted to release the locking means permitting it thereafter to be retrieved from the well by reverse circulation.

11 Claims, 7 Drawing Figures

18
19
17
16
17a
10
15d
11
12
15c
15b
15a
13
14

35
31a
31
28
29e
36a
29g
29f
36d
33
18
29d
32
36c
29c
21
36b
29b
29
25
29a
25
27
21a
25a
36
37
23
36f
36e
22
22a
24

WELL TOOL

This invention relates to pumpdown tools and, more particularly, to a locking mandrel and to the provision of a locking mandrel in a pumpdown train which includes a surface controlled safety valve, which locking mandrel can be latched in place by exerting a downward force with a running tool and which may thereafter be released to permit removal of the valve by a downward force applied to a pulling tool.

Surface controlled subsurface safety valves are widely used to protect wells from malfunctions at the wellhead. These valves have been used in pumpdown installations in which a train including the subsurface safety valve and a locating means are pumped into the well, located at the desired landing nipple, and locked in place by a locking mandrel. The locating means may be either a no-go shoulder or it may be a selective key which fits into a mating groove or grooves at the desired location in the well and prevents, as does the no-go shoulder, further downward movement of the safety valve in the well. Neither the no-go shoulder nor the selector key, however, prevent upward movement of the valve.

In order to latch the safety valve against upward movement it has been conventional to use a locking mandrel, such as the Type K Lock sold by Otis Engineering Corporation. The system is pumped into the well on a running tool and after the locating system prevents further downward movement of the tool a downward force exerted by the running tool activates the latch means to extend dogs and latch the system against upward movement. When it is desired to retrieve the valve a pulling tool is pumped into the well to engage a fish neck in the latch tool and release the latch by an upward pull. Thereafter, reverse circulation pumps the valve and latch from the well.

Many subsurface safety valves are constructed to fail-safe. That is, if any failure in the valve system occurs the valve automatically closes. Thus, reverse circulation is not possible. With such valves, however, it is normally possible to pump fluid down through the safety valve. This is easily accomplished with a flapper-type safety valve. Also, with a ball-type safety valve the construction is frequently such that the ball may be forced from its seat to permit fluid to be pumped down past the valve. Many designs of ball valves permit pumping by the closed ball with as much ease as permitted by a flapper valve. Thus, it is possible even with a closed safety valve to pump a string of tools including a pulling tol into the well and into engagement with the locking mandrel. In the past, however, this has been to no avail as all known pumpdown locking mandrels have required reverse circulation to be able to move the pulling tool upwardly after it lands to disengage the locking dogs of the locking mandrel. As reverse circulation is not possible when a safety valve is closed, normal pumpdown procedures cannot be utilized to retrieve a safety valve which has failed closed, and other procedures must be utilized to retrieve the safety valve, such as opening the well and going in with wireline equipment to retrieve the safety valve.

BRIEF SUMMARY OF THE INVENTION

As abnormal procedures for retrieving a failed safety valve are frequently quite expensive, it is desirable to have a practical locking mandrel which can be released by the application of a downward force. After the locking mandrel is released, reverse circulation will be exerted against the closed valve and as the system is no longer latched in the well the upward force applied by reverse circulation to the ball valve will drive it from the landing nipple and thereafter upwardly flowing fluid will be exerted on both the closed valve and the locomotive to retrieve the safety valve from the well.

An object of this invention is to provide a practical pumpdown locking mandrel which can be released by exerting a downward force on the locking mandrel.

Another object is to provide a subsurface safety valve which when closed will permit fluid to bypass in a downward direction in combination with a practical locking mandrel which can be released by the exertion of a downward force to permit a pulling tool to be pumped into the well above the closed subsurface safety valve, engage the locking mandrel and by the exertion of a downward force release the locking mandrel to permit the valve to be retrieved from the well by reverse circulation.

Another object is to provide a locking mandrel which is released by a downward force in which the lug expander of the mandrel when moved downward is positively latched in its downward position so that it cannot inadvertently return to lug expanding position.

Another object is to provide a locking mandrel having a lug expander and a two-piece actuator for the lug expander in which when the actuator is moved downwardly to a lug expanding position a stop is provided which prevents any further downward movement of the actuator in response to pressure on the running tool and in which a pulling tool separates the two-piece lug expander in response to downward movement and moves the separated portion of the lug expander downwardly where it is positively latched in the downward position so that after the lugs are released the two pieces of the lug expander are positively held against movement in a direction towards the lugs, thus insuring that the lugs may freely retract as the tool is pumped out of the hole.

Another object is to provide a locking mandrel which is latched and released by a downward movement in which movement of the lug expander to lug expanding position automatically results in release of the running tool and automatic latching of the lug expander in lug expanding position.

Other objects, features and advantages of the invention will be apparent from the drawings, the specification and the claims.

In the drawings wherein like numerals indicate like parts and wherein illustrative embodiments of this invention are shown,

DETAILED DESCRIPTION

Figure 1:
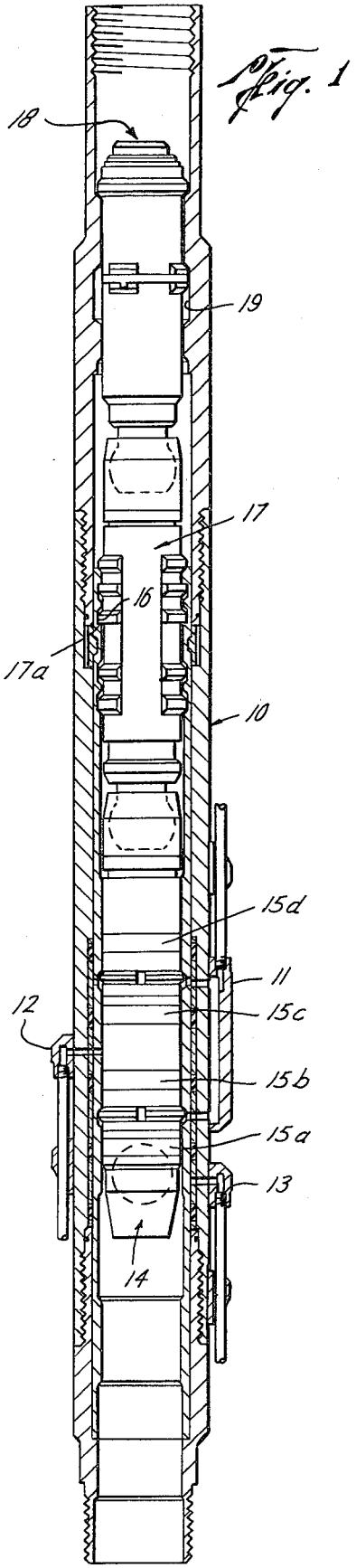
FIG. 1 is a view in cross-section through a landing nipple with a subsurface safety valve, a selective locator, and a locking mandrel shown therein in elevation.

Referring first to FIG. 1, there is indicated generally at 10 a landing nipple for receiving a subsurface safety valve, a selector locator, and a locking mandrel. The landing nipple 10 is provided with suitable bosses 11, 12 and 13 to which conduits may be connected from the surface to provide for control and operation of the subsurface safety valve. In many instances the valve will be simpler than the valve shown and only a single boss will be provided for providing control fluid pressure from the surface. In any event, no matter what type of fluid control is provided, the subsurface safety valve indicated generally at 14 may take any desired form in which pressure from above may be exerted against the valve member or its controlling mechanism and move the valve member from its seat or act on the valve member to open the valve so that fluid may pass downwardly through the safety valve. The particular construction of the safety valve is not significant to this invention except that the safety valve provides in some manner for passage of fluid downwardly through the valve in response to pressure from above. This is not objectionable and is indeed a desirable feature in a safety valve as the purpose of the valve is to protect against upwardly flowing fluid when some abnormal condition has occurred at the wellhead and it is desirable to be able to kill a well with fluid pumped down the tubing.

Suitable seal means are provided on the valve at 15*a*, 15*b*, 15*c*, and 15*d* for sealing between the subsurface safety valve 14 and the landing nipple 10.

In the landing nipple 10 there is provided a selector groove 16 in which the locating means indicated generally at 17 is located. The locator means is conventional in form and includes a plurality of keys which mate with the locating recess 16 to locate the subsurface safety valve in the well. It will be noted that the keys include a square downwardly facing shoulder 17*a* which prevents further downward movement of the assembly. As will be understood by those skilled in the art, a simple nogo shoulder could be provided if a selective key system which permits landing of the safety valve in one of selected nipples is not desired.

Secured to the upper end of the assembly is a locking mandrel indicated generally at 18 which is constructed in accordance with this invention and locks in the dog receiving recess 19 to lock the assembly against upward movement in the landing nipple.

As the equipment is designed for pumpdown the connection between the subsurface safety valve, the selector means, and the locking mandrel are provided by ball joints and the locomotive for running and retrieving the assembly is secured to the locking mandrel by an articulating joint.

Figure 2:
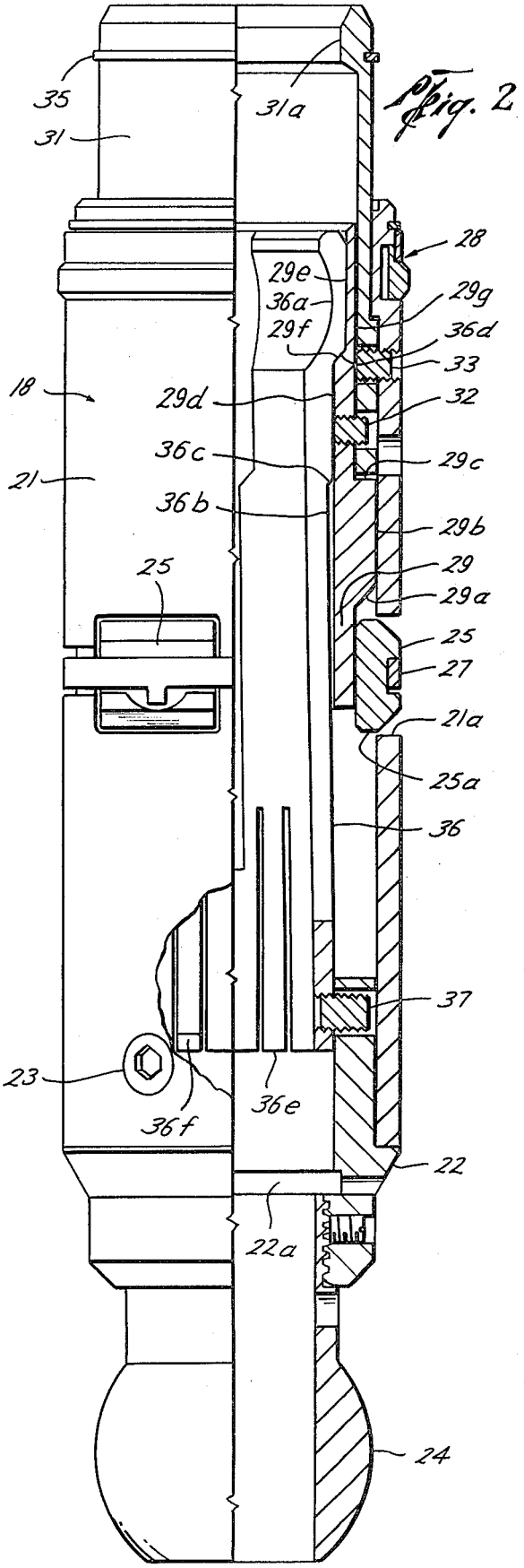
FIG. 2 is a view partly in elevation and partly in quarter-section showing a locking mandrel constructed in accordance with this invention.
Figure 3A:
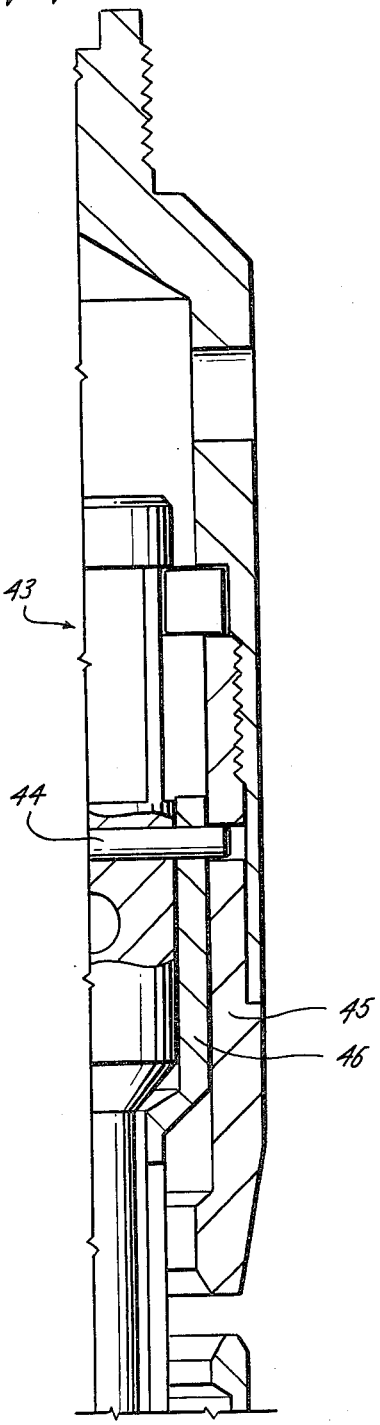
FIGS. 3A and 3B are continuation quarter-section views showing a locking mandrel constructed in accordance with this invention and a running tool for running the locking mandrel into a well.
Figure 3B:
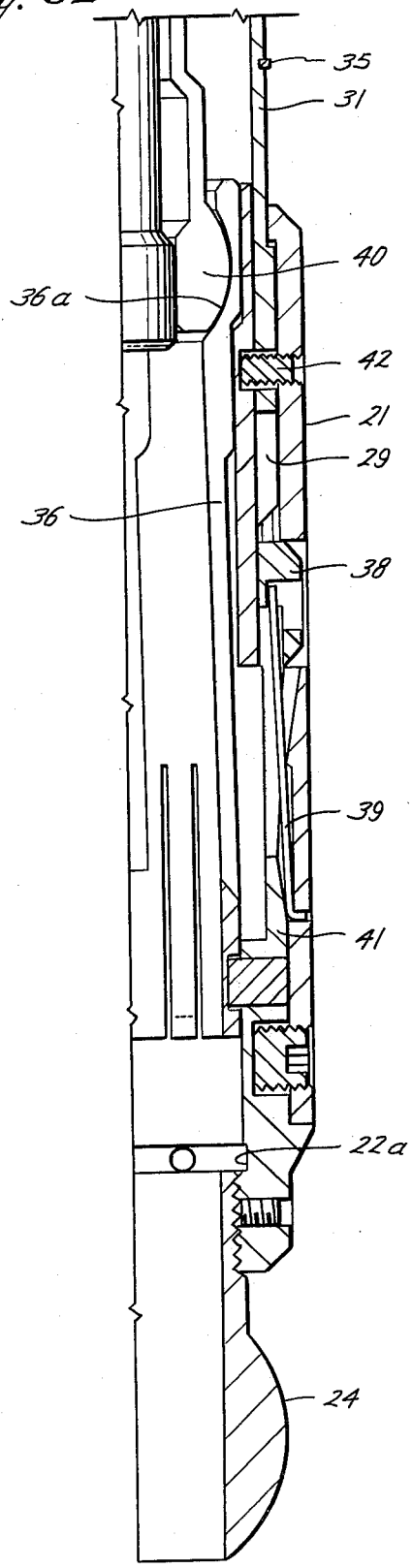

Reference is now made to FIG. 2 wherein one embodiment of the locking mandrel is shown. The mandrel includes an upper body or housing 21 secured at its lower end to a lower housing or body 22 by a plurality of socket head set screws, one of which is shown at 23. The body carries at its lower end the swivel ball 24 of a knuckle joint, the female portion of which is carried by the locator 17.

The body has at an intermediate location a plurality of windows 21*a* in which a plurality of locking dogs 25 are mounted for radial movement from a retracted position as shown to an expanded position in which they lock in a groove such as the groove 19 of the landing nipple shown in FIG. 1. The dogs are urged toward retracted position by any desired means such as the C-ring 27.

The upper body 21 carries at its upper end a debris ring assembly shown generally at 28. The ring prevents debris from passing which might interfere with operation of the locking dogs or their spring.

A dog prop-out means 29*b* is carried on release sleeve 29. The dog prop-out is provided which has three positions. In the upper position it permits the dogs 25 to retract, in the intermediate position it holds the dogs extended, and in the lower position it again permits the dogs to retract. In the FIG. 2 embodiment the dog prop-out 29*b* is provided with an external downwardly facing chamfer 29*a* so that when the prop-out 29*b* is moved downwardly from its running position shown in FIG. 2 the chamfer 29*a* will expand the dogs 25 and lead the maximum diameter portion 29*b* of the expander under the dogs 25 to extend them to their latching position.

In order to move the dogs 29*b* to their dog extending position, a setting sleeve provided by a fish neck 31 is releasably secured to the release sleeve 29 by a shear pin 32. The sleeve 29 and fish neck 31 are in effect a single expander when secured together by the shear pin 32 and they move as a unit.

In order to maintain the expander in the upper position shown during running the fish neck 31 is secured to the upper body 21 by a shear pin 33 and during running of the tool the dogs 25, the dog expander 29*b*, and the fish neck 31 will remain in the position illustrated in FIG. 2.

A positive stop is provided to limit downward movement of the release sleeve 29. This stop may be provided by the ring 35 carried on the exterior of fish neck 31.

When the train is landed and can no longer move downwardly a force exerted from above on the fish neck 31 will shear the shear pin 33 and the fish neck and release sleeve will move downwardly until the ring 35 engages the upper end of the upper body 21 to limit further downward movement. At this time the dog expander 29*b* will reside under the dogs 25 and hold them in their expanded position.

When it is desired to retrieve the locking mandrel a suitable pulling tool is introduced and a downward force is applied to the release sleeve 29 to shear shear pin 32 to release the sleeve from the fish neck 31. The release sleeve is then driven downwardly until the dog expander 29*b* passes the dogs 25 permitting them to retract to the position shown in FIG. 2. At this time the upwardly facing square shoulder 29*c* on the expander 29*b* will be below the lower square shoulder 25*a* of the dogs and with the dogs retracted by the force of the C-ring 27 the expander cannot return to its intermediate dog expanding position.

It is preferred that as the fish neck is driven downwardly the ball of the running tool will be automatically released so that the running tool may be withdrawn without further manipulation. Thus the running tool will release only when the dogs are expanded. The dogs require an enlarged recess in which to expand; therefore, the release of the running tool provides verification that the lock has been set in its proper location in the well. For this purpose the tool is provided with a collet 36 having collet fingers extending upwardly with a concave ball receiving surface 36*a* which surround and retain the ball of the running tool with the parts positioned as shown in FIG. 2.

Preferably, the inner diameter of the sleeve 29 has a small diameter portion 29*d* and a large diameter portion 29*e* to provide an upwardly facing shoulder 29*f*. The outer diameter of the collet fingers 36 have mating surfaces to engage the inner diameter sections 29*d*, 29*e*, and 29*f* of the sleeve when the tool is in running condition. The collet fingers have a reduced diameter section 36*b* to permit them to expand and as the fish neck 31 and expander 29 are driven downwardly during setting of the tool the collet fingers expand into the space between the fishing shoulder 31*a* on the fish neck 31 and the upper end of the sleeve 29. At this time the downwardly facing shoulder 36*c* on the collet fingers engages the upwardly facing shoulder 29*f* on the sleeve and latch the sleeve in its intermediate position. The downwardly facing shoulders 36*d* on the collet fingers are now positioned above the upper end of the sleeve 29 and also latch the sleeve against upward movement. As downward movement is prevented by the ring 35 the release sleeve 29 is latched in its dog expanding position and as the collet fingers are expanded to release the ball the locomotive and running tool may be withdrawn leaving the assembly in the well.

When it is desired to remove the locking mandrel and its associated string of tools the sleeve 29 is moved downwardly to a position where the prop-out 29*b* resides below the dogs permitting the dogs to retract and release from the landing nipple. To release the dogs a suitable tool is run into the well to drive the sleeve 29 downwardly. In doing so the shear pin 32 is sheared by the downward force and the release sleeve is driven downwardly until the shoulder 29*c* is below the dogs 25.

Preferably, the pulling tool engages the concave section 36*a* of the collet and drives the collet and the sleeve 29 to full down position.

To provide for movement of the collet 36 from its running to its retrieving position, the collet at its lower end is telescoped into the lower body 22 and a suitable shear pin 37 pins the collet to the body. This pin is sheared as the collet is driven to its full down position.

To positively latch the collet and thus the sleeve 29 in full down position, the collet 36 is provided with a plurality of downwardly extending collet fingers 36*e* having radially outwardly extending flanges 36*f* thereon which engage in an inwardly facing groove 22*a* in the lower housing 22. When the collet moves to its full down position these fingers 36*e* expand and the flanges 36*f* engage in groove 22*a* to positively lock the collet and the sleeve in full down position. In this position the reduced diameter section 29*g* of sleeve 29 above the shoulder 29*c* permits the dogs 25 to retract to their fully retracted position and release the landing nipple and permit the locking mandrel and its attendant string of tools to be withdrawn from the hole.

Reference is now made to FIGS. 3A, 3B, 4, 5A and 5B in which a slightly modified form of locking mandrel is shown being run, latched and unlatched. The dogs 38 are slightly different in form to permit them to accept leaf springs 39 which are held in the housing by the spring holder 41. Instead of the two shear pins 32 and 33 a single shear pin 42 is provided which is designed to shear on two planes during setting and release of the tool. Otherwise, the locking mandrel is substantially identical to that shown in FIG. 2.

Shown above the locking mandrel is a standard running tool indicated generally at 43. This tool has a depending ball 40 which mates with the socket 36*a* in the upper end of the collet 36, thus releasably latching the running tool and the locking mandrel together as the assembly is run into the well using a standard pump-down locomotive.

As the assembly reaches a point at which the selector latch 17 engages in the landing nipple and arrests downward movement, the locomotive will apply downward pressure to the running tool 43 and will shear pin 44 on a plane between the running tool housing 45 and the collet 46 which carries the collet fingers making up ball 40. This permits the outer housing to move downwardly relative to the ball 40 and the lower end of the housing 45 engages the upwardly facing shoulder of the fishing neck 31 and drives the fishing neck downwardly shearing the shear pin 42 on the plane between the upper housing 21 and the fishing neck 31. The fish neck is driven downwardly until the ring 35 engages the upper end of the housing 21 and the expander 29*b* is driven below the dogs 38 expanding them outwardly into the groove in the landing nipple.

Figure 4:
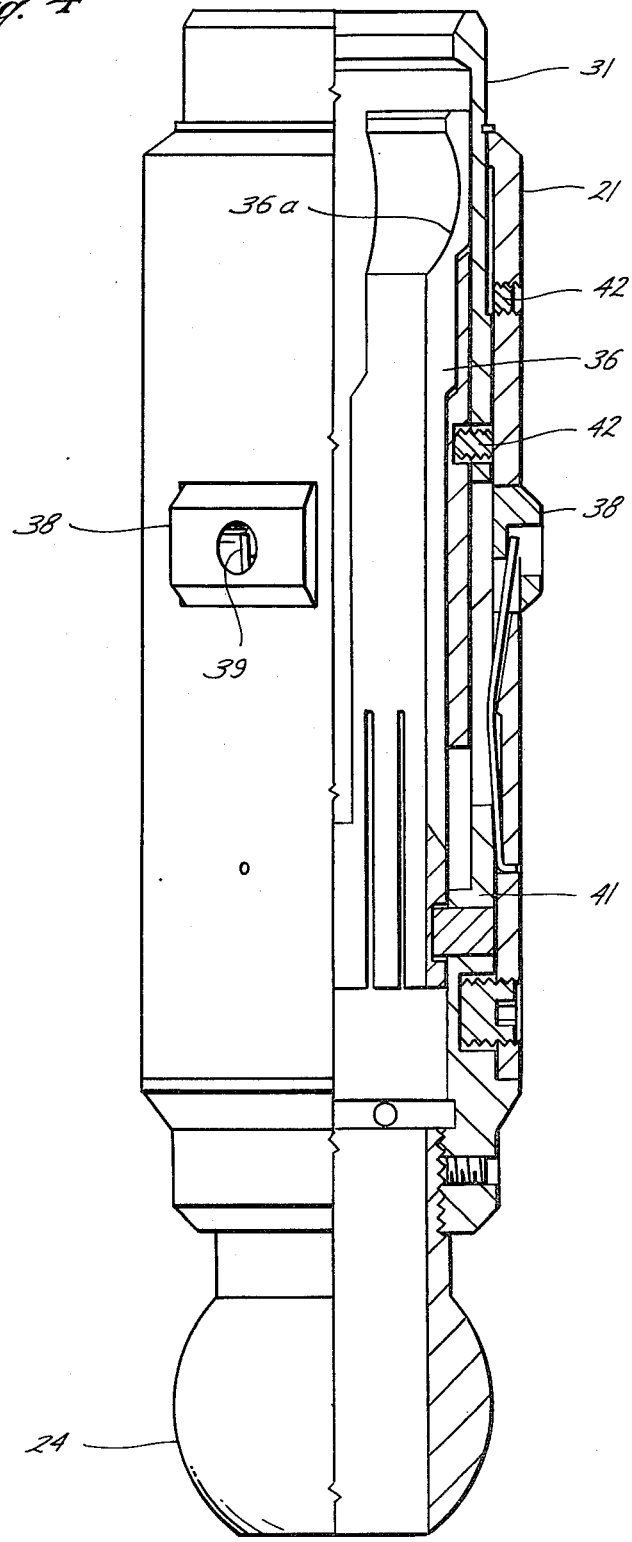
FIG. 4 is a view showing partly in elevation and partly in quarter-section the locking mandrel of FIGS. 3A and 3B in locked position.

As the fish neck moves to its full down position the upper collet fingers of collet 36 expand outwardly into the bore through the fish neck 31 as shown in FIG. 4. At this time the running tool ball 40 is released by the expansion of the upper fingers of collet 36 and the running tool may be reverse circulated out of the hole leaving the locking mandrel in the condition shown in FIG. 4 locking the locking mandrel and its associated string of tools in the landing nipple.

Figure 5A:
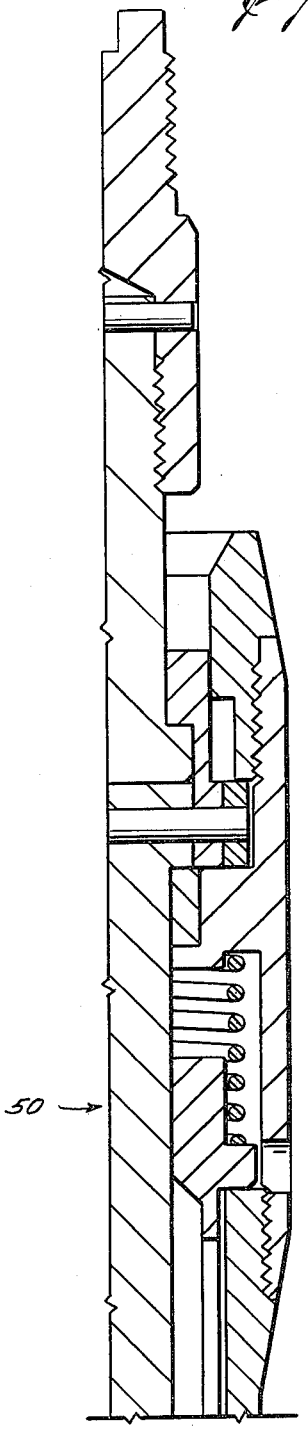
FIGS. 5A and 5B are continuation views in quarter-section of the locking mandrel of FIGS. 3A and 3B, together with a pulling tool with the locking mandrel shown in released condition and ready to be pumped from the well.
Figure 5B:
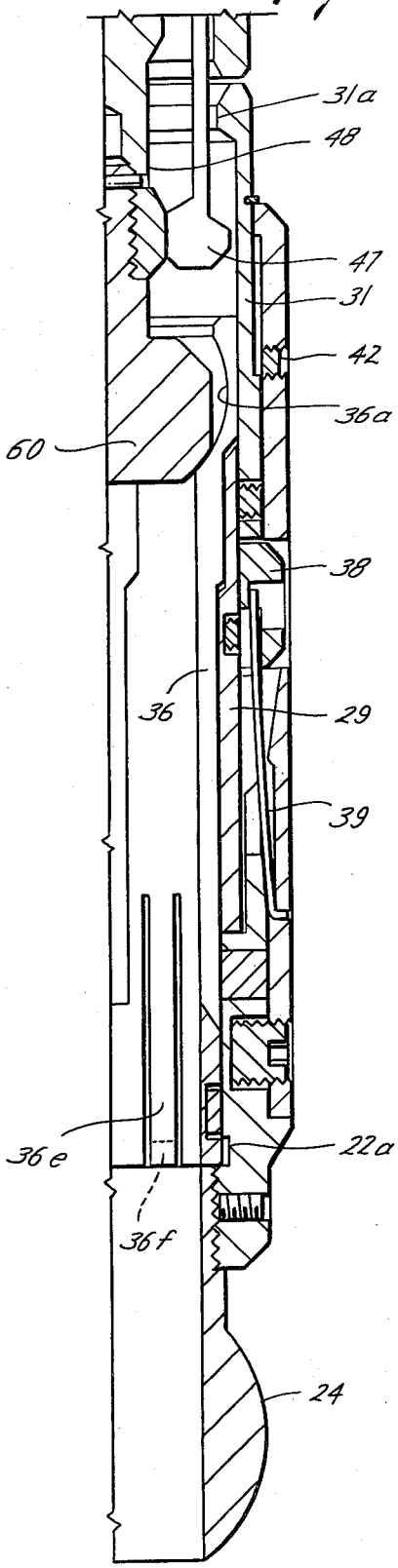

When it is desired to remove the locking mandrel a pulling tool, such as shown in FIGS. 5A and 5B, is run into the locking mandrel on a retrieving locomotive. If the subsurface safety valve has failed closed, pressure exerted in the tubing above the valve will bypass the valve and permit the locomotive to drive the pulling tool down the tubing until it engages the locking mandrel.

The pulling tool indicated generally at 50 carries at its lower end a knob 60 which engages the upwardly facing portion of the concave surface 36*a* of the collet 36. As the pulling tool moves into position the pulling collet fingers 47 retract into the reduced diameter section 48 of the knob carrier and pass the pulling flange 31*a* on the fishing neck 31.

As the pulling tool is driven downwardly by the locomotive pin 42 is sheared on the plane between the fish neck 31 and the sleeve 29. The knob 60 drives the collet 36 and the sleeve 29 downwardly until the lower collet fingers 36*e* expand into the groove 22*a* and latch the collet in full down position. At this time the springs 39 retract the dogs 38 as illustrated in FIG. 5B, releasing the locking mandrel from the landing nipple. Thereafter fluid may be reversed in the well to pump the locomotive and the locking mandrel upwardly with the pulling knob 47 engaging the fishing neck shoulder 31*a* to withdraw the locking mandrel and its associated string of tools with the locomotive. If the subsurface safety valve therebelow cannot be opened it will be appreciated that the latch is released by the downward force exerted on the locomotive and the locking mandrel is thus released from the landing nipple prior to reverse circulation. When circulation is reversed the fluid flowing upwardly in the tubing will be exerted against the lower end of the safety valve driving it upwardly out of its landing nipple, at which time fluid can flow pass the safety valve seals and be exerted on the locomotive to pump the train of tools from the well.

The foregoing disclosure and description of the invention is illustrative and explanatory thereof and various changes in the size, shape and materials, as well as in the details of the illustrated construction, may be made within the scope of the appended claims without departing from the spirit of the invention.

What is claimed is:

1. A locking mandrel comprising:

a body;

locking dogs carried by the body and extensible radially to lock the mandrel in a landing nipple;

prop-out means slidable in the body between an upper out-of-the-way position permitting the dogs to retract, an intermediate position propping said dogs in extended position, and a lower out-of-the-way position permitting said dogs to retract;

a setting sleeve movable downwardly from an upper running position to a lower setting position and moving said prop-out means from its upper out-of-the-way position to its intermediate dog extending position;

means between said body and said setting sleeve preventing movement of said setting sleeve below said lower setting position;

a release sleeve carried by said prop-out means and movable from an upper position to a lower position and moving said prop-out means to its lower out-of-the-way position to release said dogs;

means releasably securing said setting sleeve to said body in its upper running position; and means releasably securing said release sleeve to said setting sleeve.

2. The locking mandrel of claim 1 wherein means are provided for positively releasably holding said prop-out means against upward movement while in said intermediate position and non-releasably locking said prop-out means in said lower position.

3. The locking mandrel of claims 1 or 2 wherein a running collet providing a part of a knuckle joint is held in contracted position while the setting sleeve is in its upper running position and is released to expand with movement of the setting sleeve to its lower setting position;

said collect when expanded providing means releasably holding said prop-out means against upward movement while in said intermediate position.

4. The locking mandrel of claim 3 in combination with a subsurface safety valve which will bypass fluid under pressure from above the safety valve to permit a pulling tool to be pumped into engagement with the locking mandrel and release the locking mandrel by moving said releasing sleeve to said lower position.

5. The locking mandrel of claim 3 wherein the means releasably holding the prop-out means in each of said upper and intermediate positions includes shear means in each position.

6. The locking mandrel of claims 1 or 2 wherein a running collet providing a part of a knuckle joint is held in contracted position while the setting sleeve is in its upper running position and is released to expand with movement of the setting sleeve to its lower setting position, said collet when expanded providing means releasably holding said prop-out means against upward movement while in said intermediate position, said running collet providing an upwardly facing shoulder to be engaged and moved downwardly by a pulling tool and when moved downwardly shifting said release sleeve from said upper position to its lower position to move said prop-out means to its lower out-of-the-way position to release said dogs, and means releasably securing said running collet to said body.

7. The locking mandrel of claim 6 in combination with a subsurface safety valve which will bypass fluid under pressure from above the safety valve to permit a pulling tool to be pumped into engagement with the locking mandrel and release the locking mandrel by moving said releasing sleeve to said lower position.

8. The locking mandrel of claim 6 wherein the means releasably holding the prop-out means in each of said upper and intermediate positions includes shear means in each position.

9. The locking mandrel of claims 1, or 2 in combination with a subsurface safety valve which will bypass fluid under pressure from above the safety valve to permit a pulling tool to be pumped into engagement with the locking mandrel and release the locking mandrel by moving said releasing sleeve to said lower position.

10. The locking mandrel of claim 9 wherein the means releasably holding the prop-out means in each of said upper and intermediate positions includes shear means in each position.

11. The locking mandrel of claims 1, or 2 wherein the means releasably holding the prop-out means in each of said upper and intermediate positions includes shear means in each position.

* * * * *